United States Patent [19]

Stone et al.

[11] Patent Number: 4,687,882

[45] Date of Patent: Aug. 18, 1987

[54] SURGE ATTENUATING CABLE

[76] Inventors: Gregory C. Stone, 25 Holloway Road, Toronto, Ontario, Canada, M9H 1E9; Steven A. Boggs, 63 Pears Avenue, Toronto, Ontario, Canada, M5R 1S9; Jean-Marie Braun, 32 Hudson Drive, Toronto, Ontario, Canada, M4T 2J9

[21] Appl. No.: 856,383

[22] Filed: Apr. 28, 1986

[51] Int. Cl.[4] ..... H01B 7/34

[52] U.S. Cl. ..... 174/102 SC; 174/105 SC; 174/106 SC; 333/243

[58] Field of Search ..... 174/102 SC, 105 SC, 174/106 SC, 120 SC; 333/243

[56] References Cited

U.S. PATENT DOCUMENTS

| | | | |
|---|---|---|---|
| 3,643,004 | 2/1972 | McKean | 174/102 SC X |
| 4,109,098 | 8/1978 | Olsson et al. | 174/106 SC |
| 4,347,487 | 8/1982 | Martin | 333/243 X |
| 4,361,723 | 11/1982 | Hvizd, Jr. et al. | 174/102 SC |
| 4,486,721 | 12/1984 | Cornelius et al. | 333/243 X |
| 4,499,438 | 2/1985 | Cornelius et al. | 333/243 X |
| 4,510,468 | 4/1985 | Mayer | 333/243 X |

*Primary Examiner*—Morris H. Nimmo
*Attorney, Agent, or Firm*—Ridout & Maybee

[57] ABSTRACT

In a shielded power cable of the type comprising inner and outer conductors separated by cable insulation defining a displacement current path between the conductors for high frequency currents, the cable insulation incorporates one or more coaxial layers of semiconductive material consisting of cable insulation material loaded with a conductive filler, such as carbon fibres or spheres. The semiconductive layer is designed to maximize high frequency losses thereby to facilitate attenuation of high voltage surges caused by lightning or by switching.

16 Claims, 7 Drawing Figures

SURGE ATTENUATING CABLE

This invention relates to high voltage electrical power cables, used in power transmission and distribution lines, for example, and is concerned particularly with such cables that are designed to attenuate voltage surges, caused by lightning and by switching for example, consisting largely of high frequency components.

A typical shielded power cable capable of attenuating lightning and switching surges by introducing high frequency losses along its length comprises inner and outer conductors separated by a cable insulating system, the cable insulation system comprising three coaxial layers defining a displacement current path between the conductors for high frequency currents, the three coaxial layers being an inner semiconductive layer, an outer semiconductive layer, and an intermediate non-conductive layer. A typical semiconductor layer consists of a conductive polymer or an insulator such as polyolefin filled with a conducting matrix.

The present invention is based on the discovery that the configuration and the materials of the layers forming the cable can be optimized so as to maximize the power loss per unit length of cable at a given high frequency, and so to maximize the power loss per unit length for a typical surge. Thus it becomes possible to design a cable so as to minimize the propagation of surges along the line. The ability of the cable to transmit power frequency (e.g. 60 Hz) currents is no way impaired.

If the inner semiconductor layer presents a conductance $G_1$ and a capacitance $C_1$ per unit length of cable, if the outer semiconductive layer presents a conductance $G_2$ and a capacitance $C_2$ per unit length of cable, and if the intemediate layer with negligible conductance presents a capacitance C per unit length of cable, then the power loss P per unit length of cable with one volt applied at a given frequency $w/2\pi$ is given by $$P=G_1|V_1|^2+G_2|V_2|^2$$

$V_2$being the voltage drops across the inner semiconductive layer and the outer semiconductor layer, respectively, where $$V_1=Z_1/(Z_1+Z_2+Z_3+Z) \text{ and}$$

$$V_2=Z_2/(Z_1+Z_2+Z_3+Z)$$

where $$Z_1=\frac{1}{G_1}\cdot\frac{1-jwC_1}{1+(wC_1/G_1)^2}$$

$$Z_2=\frac{1}{G_2}\cdot\frac{1-jwC_2}{1+(wC_2/G_2)^2}$$

$$Z_3=-j/wC, \quad \text{and}$$

$$Z=\left(\frac{1}{2\sqrt{2\pi a_1\sigma_1}}+\frac{1}{2\sqrt{2\pi a_2\sigma_3}}\right)\cdot(1+j)+\frac{jw\mu_o\log(a_2/a_1)}{2\pi}$$

where $\mu_0=400\pi\times10^{-9}$ $a_1$ = radius of inner conductor $a_2$ = inner radius of outer conductor $\sigma_1$ = conductivity of inner conductor $\sigma_3$ = conductivity of outer conductor.

The parameters $C_1$, $C_2$, $G_1$ and $G_2$ can be expressed as follows:

$$C_1=\frac{2\pi\epsilon_r\epsilon_o}{\log\frac{a_1+t_1}{a_1}}$$

$$C_2=\frac{2\pi\epsilon_r\epsilon_o}{\log\frac{a_2}{a_2-t_2}}$$

$$G_1=\frac{2\pi\sigma_2}{\log\frac{a_1+t_1}{a_1}}$$

$$G_2=\frac{2\pi\sigma_4}{\log\frac{a_2}{a_2-t_2}}$$

where $\epsilon_o=8.85\times10^{-12}$ $\epsilon_r$ = relative permattivity of the semiconductive layers $\sigma_2$ = conductivity of the inner semiconductive layer $\sigma_4$ = conductivity of the outer semiconductive layer $t_1$ = thickness of the inner semiconductive layer $t_2$ = thickness of the outer semiconductive layer.

In order to maximize the power loss per unit length P, at the selected frequency $w/2\pi$, it is necessary that the relative permittivity of the semiconductive layers be small and that the conductivities of the inner and outer conductors, and the dielectric constants of the inner and outer semiconductor layers be such that the following equations are satisfied:

$$\frac{\partial P}{\partial G_1}=O \text{ and } \frac{\partial P}{\partial G_2}=O$$

In other words, the power loss per unit length of cable must be maximized with respect to the conductance of each of the semiconductive layers.

All cables presently manufactured will attenuate surges to some extent, and shielded power cables of the type referred to above will certainly do so. The most effective surge attenuation is achieved by maximizing power losses at the surge frequency in accordance with the criteria formulated above. However, present manufacturing methods do not take advantage of this possibility of optimizing cable design owing to their reliance on materials which preclude the possibility. For example, the material most commonly used for the semiconductive layers of the cable insulation is a polyolefine loaded with carbon black which, owing to the highly structured nature if carbon black, has a high permittivity and exhibits sharp changes in both permittivity and conductivity with frequence. The inventors have reasoned that, to be useful for surge attenuation, the material should offer low permittivity and exhibit no sharp changes in permittivity and conductivity with increasing frequency since this will decrease the surge attenuation. The inventors have investigated the electrical properties of a range of materials which might be used in cable manufacture and have selected those materials which exhibit desirable electrical properties consistent with ease and economy of manufacture.

In order that the invention may be readily understood, the design and construction of a surge attenuating cable in accordance with the invention will now be described, by way of example, with reference to the accompanying drawings. In the drawings.

From theoretical considerations the inventors have correctly predicted the propagation characteristics of high frequency signals in high voltage power cables of the type having semiconductive shields. It was predicted, and subsequently confirmed experimentally, that for frequencies in excess of 1 MHz the major power loss in such a cable occurs in the semiconductive shields. It follows that the attenuation of high frequency signals propagated along such cables is primarily determined by the electrical and geometrical characteristics of the semiconductive shields.

Power transmission and distribution lines having significant high frequency attenuation may be useful in several power system applications. Since lightning and switching surges consist largely of high-frequency components, surges introduced into such a cable are rapidly attenuated as they propagate. The magnitude of the voltage at the far end of the cable will be reduced and the rise time of the surge will be increased, exposing terminal equipment such as transformers and rotating machines to a reduced hazard level. In addition, less of the power line itself is exposed to the initial high-voltage surge, thereby reducing the probability of line or cable failure.

The implications of these considerations will now be examined with reference to particular applications, including shielded high voltage power cables used in distribution and generator station service situations, and gas-insulated bus ducts.

Figure 1:
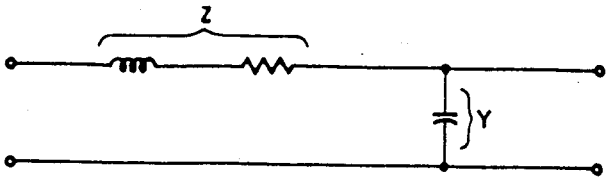
FIG. 1 is a diagram of one segment of the equivalent circuit of a conventional power cable transmission line.

One segment of the equivalent circuit of a conventional transmission line is shown in FIG. 1. The propagation characteristics of signals can be estimated from the per unit length cable characteristics. In particular, the attenuation is determined from the real part of $\sqrt{ZY}$. If no semiconductive shields are present, the attenuation is dominated by the skin effect of the conductor as well as losses in the dielectric. However, it is known that the measured attenuation of high-frequency signals in high voltage power cables has always been much greater than estimated by the simple transmission line model of FIG. 1. A new model has therefore been developed by the inventors, which takes into account the inner and outer semiconductive (e.g., carbon-loaded) shields that are part of all shielded power cables. In this model, the capacitive charging, or displacement, current must pass radially through the semiconductive shields, creating a power loss in the shields and thus increasing the cable's attenuation.

Figure 2:
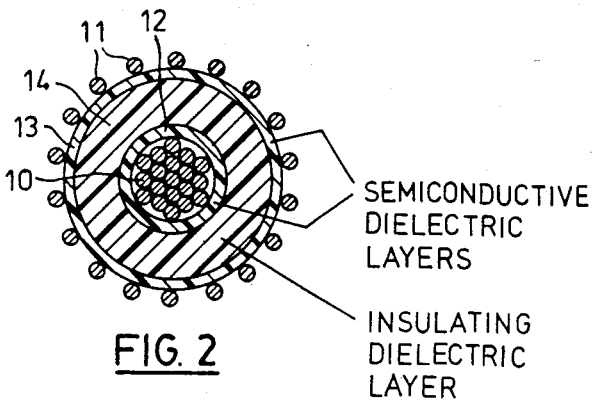
FIG. 2 is a diagrammatic cross-sectional view of a shielded power cable in accordance with the invention.

As illustrated in FIG. 2, a shielded power cable typically comprises a central conductor 10, which is usually stranded, an outer conductor 11, which is also stranded, or alternatively fabricated from metallic tapes, and a cable insulation system consisting essentially of three coaxial layers, namely an inner semiconductive layer 12, an outer semiconductive layer 13, and an intermediate non-conductive layer 14. The intermediate layer is of a polymeric dielectric material, such as a polyolefin or blend of rubbers, commonly used in cable manufacture. The layers 12 and 13 are also of such material and are made semiconductive by the incorporation of conductive fillers, such as carbon black, graphite etc.

Figure 3:
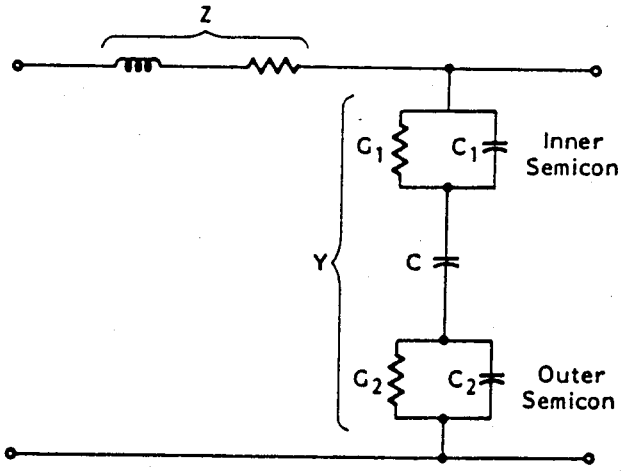
FIG. 3 shows one segment of the equivalent circuit of the cable illustrated in FIG. 2.

FIG. 3 shows the lumped element equivalent circuit of such a cable, or rather one segment of the circuit representing an elemental length. In this diagram the inner semiconductive layer 12 is represented by a capacitance $C_1$ shunted by a conductance $G_1$; the outer semiconductive layer 13 is represented by a capacitance $C_2$ shunted by a conductance $G_2$; and the intermediate layer 14 is represented by a capacitance C, its conductance being negligible. The conductor is represented by the resistive-inductive impedance element Z. Since the insulation displacement current increases with frequency, the attenuation of the cable must also increase with frequency. The influence of the semiconductive shields on power loss at power frequency (typically 60 Hz) is negligible.

Although the attenuation in a standard power cable is greater than predicted by the conventional transmission line model, it is not as high as it could be. That is, by adjusting the capacitance and conductance of the semiconductive layers, much greater attenuation is possible. As stated above, this greater attenuation may reduce the risk of failure of the cable and connected equipment.

Figure 5:
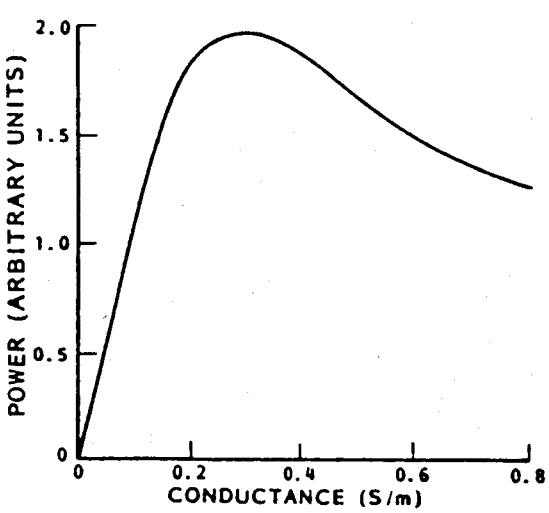
FIG. 5 is a graph illustrating relative power loss in a cable as a function of conductance of the semiconductive layers.
Figure 4:
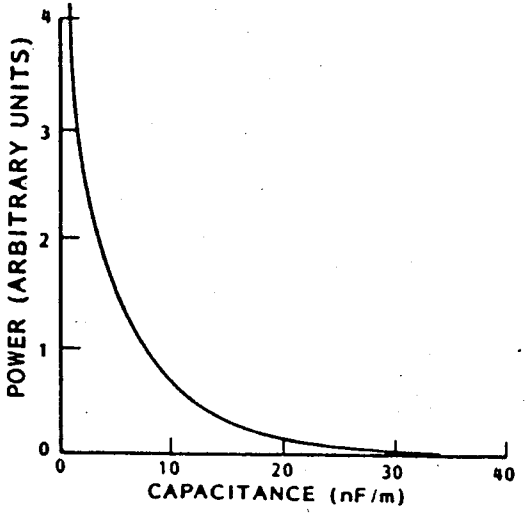
FIG. 4 is a graph illustrating relative power loss in a cable as a function of capacitance of the semiconductive layers.
Figure 7:
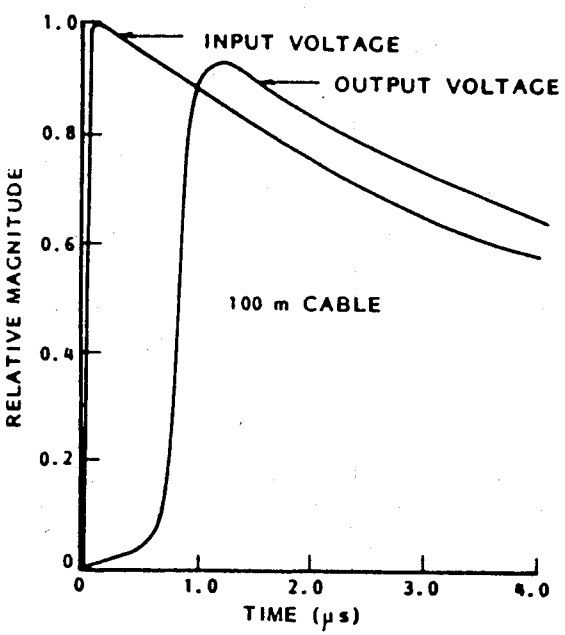
FIG. 7 illustrates the change in the fast wavefront switching surge as it propagates through 100 m. of an optimized power cable.

Graphs of real power loss, which is directly proportional to surge attenuation, against semiconductive layer capacitance and conductance are shown in FIGS. 4 and 5. These plots are for a single semiconductive layer 3 mm. thick on the surface of the high voltage conductor in a simple cable. It is apparent from FIG. 4 that increasing the capacitance of the semiconductive layer, by decreasing the layer thickness or its dielectric permittivity, decreases the power loss, and so decreases the attenuation. In order to maximize the attenuation, therefore, the capacitance of the layer should be as low as possible. However, the minimum capacitance attainable is limited by the geometry of the cable and by the electrical properties of the materials used. Referring now to FIG. 5, which is a plot of power loss as a function of conductance of the semiconductive layer, it will be seen that there is an optimum conductance which will maximize the power loss and therefore the attenuation. Analysis of the more typical power cable design with two semiconductive conductive layers reveals the same criteria.

$SF_6$ Switchgear

Another possible application is to cover the high voltage conductor in a gas-insulated switchgear with an optimized semiconductive layer. High-voltage transients with frequencies up to 50 MHz are generated by disconnect-switch operations. These transients are suspected of causing breakdowns in the gas-insulated switchgear. Table 1 shows the maximum possible attenuation obtainable in a 230-kV bus duct with a 3-mm. thick semiconductive layer over the conductor.

can become faulted. If surge attenuating cables are used between the switches and the rotating machines, the fast risetime will be slowed sufficiently without any increased cost or reduced reliability.

TABLE I

MAXIMUM POSSIBLE ATTENUATIONS

| Application | Insulation Capacitance (pF/m) | Semicon Capitance (pF/m) Inner | Semicon Capitance (pF/m) Outer | Semicon Conductance (S/m) Inner | Semicon Conductance (S/m) Outer | Attenuation (db/m) 1 MHz | Attenuation (db/m) 10 MHz | Attenuation (db/m) 50 MHz |
|---|---|---|---|---|---|---|---|---|
| Optimized $SF_6$ Bus Duct (230 kV, 0.11 m dia conductor) | 57 | 4700* | — | 0.28 | — | $2 \times 10^{-4}$ | 0.006 | 0.01 |
| Commercial Power Cable (46 kV, EPR, 2/0) | 192 | 3600 | 10,000 | 0.4 | 0.9 | <0.01 | 0.045 | 0.2 |
| Optimized Power Cable (46 kV, EPR, 2/0) | 192 | 185** | 400 | 0.004 | 0.08 | 0.02 | 0.15 | 3.4 |
| Optimized Power Cable (15 kV, XLPE, 250 MCM) | 365 | 165** | 303 | 0.06 | 0.1 | <0.1 | 0.35 | 5.0 |

*minimum capacitance, 3 mm thick, $\epsilon r = 2.3$
**minimum capacitance, 3 mm thick, $\epsilon r = 1.0$

Shielded Power Cable

Shielded power cables already contain inner and outer semiconductive layers arranged coaxially as shown in FIG. 2. However, the attenuation of commercially available power cables is quite low when compared to a cable made with "optimized" semiconductive layers. Table 1 gives attenuations for 46-kV EPR-insulated cable with and without optimized semiconductive layers. The attenuations in the commercial cable were measured, whereas the values quoted for the optimized cable are calculated.

The attenuations possible in shielded cables are reasonably high. In an underground distribution system, a cable may be exposed to lightning surges (frequencies of several hundred kHz) whereas in generator station service use, fast switching surges can be present (frequencies up to 20 MHz). The effect of the optimized cable on such transients can be estimated using Fourier transforms.

Propagation of Surges in Optimized Power Cable

Figure 6:
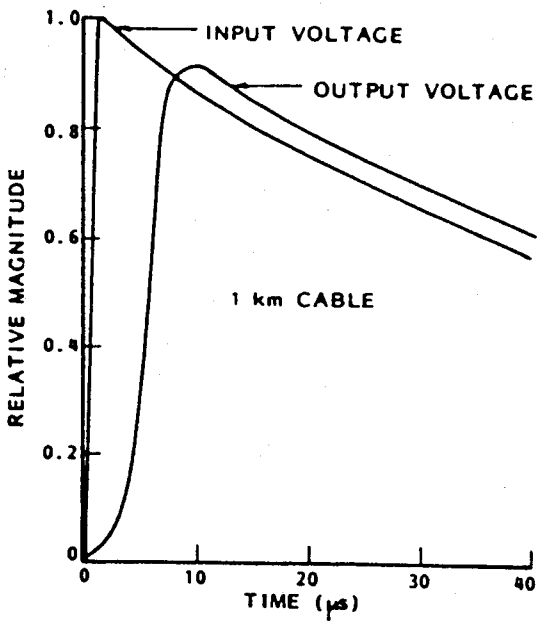
FIG. 6 illustrates the input/output voltage relationship for a lightning surge at the beginning and end of a 1-km optimized power cable.

The output voltage from a 1 km. optimized 46-kV EPR Cable (Table 1) when exposed to an input 1-μs rise time lightning surge is shown in FIG. 6. The wavefront is slowed to about 5 μs (10%-90%) with the magnitude reduced from 1 pu to 0.9 pu. By comparison, the output of 1 km of the commercial (non-optimized) 46-kV cable is virtually unchanged. The drop in lightning impulse amplitude is probably not enough to have an important effect on the distribution cable system reliability, except for very long runs, greater than 5 km. The effect of the optimized cable on distribution transformer reliability may be beneficial however, since the wavefront is considerably slowed. Fast wavefronts can cause the surge voltage to "pile-up" across the first few turns of the transformer winding, resulting in failure of turn insulation.

Surges with rise times of 0.1 to 0.2 μs can result from switch and circuit breaker operations. These surges, when applied to rotating machines such as hydraulic generators and large motors, are known to cause catastrophic insulation failure of the turns. The primary means to mitigate the effect of these surges is to increase the rise time by means of "wave-sloping" capacitors mounted at the terminals. These capacitors, however, may not be effective if they are not well grounded with low-inductance leads, and the capacitors themselves FIG. 5 shows the effect on a 0.1-μs rise time transient propagating through only 100 m of the optimized 46-kV cable. The wavefront is stretched to 0.5 μs (10%-90%), and the output magnitude is 93% of the input. After 1 km, the wavefront is 1.8 μs long, and the amplitude is 0.72 pu. For the 15-kv cable in Table 1, which is more typical of a generator station service cable, the rise time would be even longer because of the greater attenuation. The optimized power cable is therefore of use in reducing the surge hazard in generator station service applications.

The problem of designing an effective surge attenuating power cable, therefore, is to determine the optimum conductance for each semiconductive layer of the cable insulation so as to maximize the high frequency power loss per unit length of cable. Referring to FIG. 3, the power loss per unit length at a given frequency $w/2\pi$ P is given by $$P = G_1|V_1|^2 + G_2|V_2|^2$$

$V_1$ and $V_2$ being the voltage drops across the inner semiconductive layer and the outer semiconductive layer, respectively, when the applied voltage is one volt, where $$V_1 = Z_1/(Z_1+Z_2+Z_3+Z) \text{ and}$$

$$V_2 = Z_2/(Z_1+Z_2+Z_3+Z)$$

The impedances $Z_1$, $Z_2$ and $Z_3$ are determined by the electrical characteristics of the semiconductive layers, namely their respective capacitances, per unit length $C_1$, $C_2$ and their respective conductances, per unit length $G_1$, $G_2$. Thus $$Z_1 = \frac{1}{G_1} \cdot \frac{1 - jwC_1}{1 + (wC_1/G_1)^2}$$

$$Z_2 = \frac{1}{G_2} \cdot \frac{1 - jwC_2}{1 + (wC_2/G_2)^2}$$

$$Z_3 = -j/wC$$

The impedance Z at the frequency $w/2\pi$ is determined by the geometry and conductivities of the inner and outer conductors.

Thus $$Z = \left( \frac{1}{2\sqrt{2\pi a_1 \sigma_1}} + \frac{1}{2\sqrt{2\pi a_2 \sigma_3}} \right) \cdot (1 + j) + \frac{jw\mu_o \log(a_2/a_1)}{2\pi}$$

where $\mu_0 = 400 \times 10^{-9}$ $a_1$ = radius of inner conductor $a_2$ = inner radius of outer conductor $\sigma_1$ = conductivity of inner conductor $\sigma_3$ = conductivity of outer conductor.

Since all the above parameters are given, or can be measured, one can readily ascertain the conductances $G_1, G_2$ required in order to maximize the power loss P at the selected frequency. The required condition is given by $$\frac{\partial P}{\partial G_1} = O \text{ and } \frac{\partial P}{\partial G_2} = O$$

In other words, the power loss per unit length of cable must be maximized with respect to the conductance of each of the semiconductive layers.

It should be noted that the above condition can equally be obtained for the case in which the cable insulation has only one semiconductive layer, since in this case $Z_1$ (or $Z_2$ as the case may be) become zero.

The inventors have investigated a range of specially formulated semiconductive polyolefins and rubbers, consisting of polymeric material loaded with conductive fillers, which might be used in cable manufacture. The measured conductivity and relative permittivity for each one, over a frequency range 1 MHz–50 MHz, is given in Table 2.

TABLE 2

ELECTRICAL PROPERTIES OF POLYOLEFINS LOADED WITH SPECIFIED FILLERS

| FILLER MATERIAL | FREQUENCY (MHz) 1 | 2 | 5 | 10 | 50 |
|---|---|---|---|---|---|
| Conventional | | | | | |
| σ (mS/m) | 0.2 | 0.4 | 1.7 | 3.4 | 11 |
| εr | 25 | 24 | 19 | 16 | 9.6 |
| Branched, i.e. high structure, XC72[a] | | | | | |
| σ (S/m) | 0.6 | 0.7 | 0.8 | 1.6 | 11 |
| εr | 8800 | 7800 | 7500 | 6300 | 3700 |
| Carbon Fibre[b] | | | | | |
| σ (S/m) | 0.03 | 0.03 | 0.03 | 0.03 | 0.05 |
| εr | 39 | 36 | 33 | 29 | 19 |
| Spherical N990[c] (660 g/Kg) | | | | | |
| σ (S/m) | 1.1 | 1.1 | 1.1 | 1.1 | 1.2 |
| εr | 115 | 115 | 110 | 102 | 64 |
| Carbospheres[d] | | | | | |
| σ (S/m) | 4.5 | 4.5 | 4.5 | 4.5 | 4.5 |
| εr | 12 | 12 | 12 | 12 | 12 |

εr is the relative dielectric permittivity
σ is the conductivity
[a]Cabot Co., Vulcan XC-72. Carbon black
[b]Great Lakes Carbon Co., Fortafil
[c]J. M. Huber Co., BT-1332. carbon black
[d]Versar Mfg. Inc.

Table 3 illustrates a comparison between the surge attenuations possible, at three different frequencies, 1 MHz, 5 MHz and 10 MHz, with a conventional 2 kV, 2 AWG cable and an optimized cable in accordance with the invention. In this case, the conductive filler of the optimized cable consists of carbospheres.

TABLE 3

COMPARISON OF SURGE ATTENUATION FOR A CONVENTIONAL AND OPTIMIZED 5 kV, 2 AWG CABLE

| | FREQUENCY (MHz) 1 | 5 | 10 |
|---|---|---|---|
| Conventional | | | |
| εr | 25 | 19 | 16 |
| σ (mS/m) | 0.2 | 1.7 | 3.4 |
| α (db/m) | 0.006 | 0.04 | 0.1 |
| Optimized | | | |
| εr | 12 | 12 | 12 |
| σ inner (mS/m) | 0.7 | 3.6 | 7.2 |
| σ outer (mS/m) | 0.8 | 4 | 8 |
| α (db/m) | 0.02 | 0.10 | 0.29 |

εr and σ refer to the relative permittivity and conductivity of the semiconductive layers Clearly, since the frequency $w/2\pi$ was selected arbitrarily for the purpose of the previous discussion and the spectrum of a surge will normally cover a range of frequencies, a first consideration in the selection of a suitable semiconductive material is that its conductivity and permittivity should not be highly frequency dependent. Evidently the following conductive fillers, according to the tabulated measurements, are quite unsuitable, all being high structure carbon blacks:

BP 2000 carbon black at 250 g/kg loading

BP 2000 carbon black at 120 g/kg loading

XC-72 carbon black at 360 g/kg loading.

On the other hand, the following fillers, compounded with the polyolefin in the amounts indicated in the Table, are most satisfactory so far as frequency dependence is concerned Carbon fibres at 30 g/kg Carbospheres at 250 g/kg Spherical N990 carbon black at 660 g/kg.

It can readily be deduced that the greatly increased performance of there last materials is due to the fact that the filler particles at not highly structured, but are structured as smooth filaments in the case of the carbon fibres, and as spheres in the case of the last two fillers. This is borne out by the fact that the spherical carbon fillers perform even better than the carbon fibres, and all three are spectacularly different in frequency performance, and in permittivity, from the high structure carbon black fillers. Silver-coated glass beads, which also have a nearly spherical structure, also exhibit excellent frequency-insensitive properties.

It will be observed that the polyolefins loaded with fillers which are not highly structured, in contrast to those which are loaded with high structure carbon black, have acceptably low permittivities, and so the semiconductive layers formed of these materials can be designed with low capacitance per unit length.

In summary, the present invention provides a shielded power cable comprising inner and outer conductors separated by a cable insulation system which provides a displacement current leakage path between the conductors for high frequency currents, wherein the cable insulation system incorporates one or more coaxial semiconductive layers, the material of the semiconductive layer or layers having a conductivity which remains substantially constant over the frequency range 1 MHz to 50 MHz, and a relative permittivity which does not exceed about 12 over the frequency range 0.1 MHz to 50 MHz.

The material of the semiconductor layer or layers is an extrudable polymeric material, or blend of polymeric materials, commonly used in cable manufacture, loaded with a conductive filler. The particles of the filler are essentially smooth surfaced, namely filamentary or spherical, in contrast to the highly structured particles of high structure carbon blacks. The conductive particles may be carbon fibres, carbospheres or carbon black typified by the Spherical N990 manufactured by J. M. Huber Co. Carbon fibres are preferred because of the relatively low loading requirements.

What we claim is:

1. A shielded power cable comprising inner and outer conductors separated by a cable insulation system, the cable insulation system comprising at least two coaxial layers defining a displacement current path between the conductors for high frequency currents, namely an inner semiconductive layer presenting a conductance $G_1$ and a capacitance $C_1$ per unit length of cable, and an outer insulating layer presenting a capacitance C per unit length of cable, wherein the conductivity, relative permittivity, and thickness of said inner semiconductive layer are such that the power loss per unit length of cable is maximized with respect to the conductance $G_1$ at least over the frequency range 0.1 MHz–50 MHz.

2. A shielded power cable comprising inner and outer conductors separated by a cable insulation system, the cable insulation system comprising at least three coaxial layers defining a displacement current path between the conductors for high frequency currents, namely the inner semiconductive layer presenting a conductance $G_1$ and a capacitance $C_1$ per unit length of cable, an outer semiconductive layer presenting a conductance $G_2$ and a capacitance $C_2$ per unit length of cable, and an intermediate insulating layer presenting a capacitance C per unit length of cable, wherein the conductivities, relative permittivities, and the thicknesses of said semiconductive layers are such that the power loss per unit length of cable is maximized with respect to both said conductance $G_1$ of the inner semiconductive layer and said conductance $G_2$ of the outer semiconductive layer at least over the frequency range 0.1 MHz–50 MHz.

3. A shielded power cable according to claim 2, wherein the material of the semiconductive layers has a conductivity which remains substantially constant and a relative permittivity which does not exceed about 12 over the frequency range 0.1 MHz–50 MHz.

4. A shielded power cable comprising inner and outer conductors separated by a cable insulation system which provides a displacement current path between the conductors for high frequency currents, the cable insulation system incorporating at least one semiconductive layer arranged coaxially therewith having a conductivity which remains substantially constant and a relative permittivity which does not exceed about 12, over the frequency range 0.1 MHz–50 MHz.

5. A shielded power cable according to claim 4, wherein the cable insulation system incorporates a second semiconductive layer of the same material as the first.

6. A shielded power cable comprising inner and outer conductors separated by a cable insulation system, the cable insulation system comprising three coaxial layers defining a displacement current path between the conductors for high frequency currents, namely an inner semiconductive layer, an outer semiconductive layer, and an intermediate insulating layer, wherein the materials of said semiconductive layers is an extrudable polymeric material loaded with a low structure particulate conductive filler, and wherein the material of said layers has a conductivity which remains substantially constant, and a relative permittivity which does not exceed about 12, over the frequency range 0.1 MHz–50 MHz.

7. A shielded power cable according to claim 6, wherein the polymeric material is a material selected from the group consisting of a polyolefin and a blend of rubbers.

8. A shielded power cable according to claim 7, wherein the conductive filler consists of carbon fibres.

9. A shielded power cable according to claim 7, wherein the conductive filler consists of carbon spheres.

10. A shielded power cable according to claim 7, wherein the conductive filler is metallic.

11. An electrical power transmission system comprising inner and outer coaxial conductors separated by an insulation system, the insulation system extending longitudinally with respect to the conductors and comprising at least two coaxial regions defining a displacement current path between the conductors for high frequency currents, namely an inner region consisting of a semiconductive layer presenting a conductance $G_1$ and a capacitance $C_1$ per unit length, and an outer non-conductive region presenting a capacitance C per unit length, characterized in this that the conductivity, relative permittivity and thickness of said semiconductive layer are such that the power loss per unit length of the transmission system is maximized with respect to the conductance $G_1$ at least over the frequency range 0.1 MHz–50 MHz.

12. An electrical power transmission system according to claim 11, wherein the material of said semiconductor layer is an extrudable polymeric material loaded with a low structure particulate conductive filler, said material having a conductivity which remains substantially constant, and a relative permittivity which does not exceed about 12, over the frequency range 0.1 MHz–50 MHz.

13. An electrical power transmission system according to claim 12, wherein the polymeric material is a material selected from the group consisting of a polyolefin and a blend of rubbers.

14. An electrical power transmission system according to claim 13, wherein the conductive filler consists of carbon fibres.

15. An electrical power transmission system according to claim 13, wherein the conductive filler consists of carbon spheres.

16. An electrical power transmission system according to claim 13, wherein the conductive filler is metallic.

* * * * *

UNITED STATES PATENT AND TRADEMARK OFFICE

CERTIFICATE OF CORRECTION

PATENT NO. : 4,687,882

DATED : August 18, 1937

INVENTOR(S) : Gregory C. Stone et al

It is certified that error appears in the above-identified patent and that said Letters Patent is hereby corrected as shown below:

Column 1, lines 61-65, and Column 7, lines 1-7 change $$Z = \left[\frac{1}{2\sqrt{2\pi a_1 \sigma_1}} + \frac{1}{2\sqrt{2\pi a_2 \sigma_3}}\right] \cdot (1+j) + \frac{jw\mu_0 \log(a_2/a_1)}{2\pi}$$

to:

$$Z = \sqrt{\mu_0 w}\left[\frac{1}{2\pi a_1 \sqrt{2\sigma_1}} + \frac{1}{2\pi a_2 \sqrt{2\sigma_3}}\right] \cdot (1+j) + \frac{jw\mu_0 \log(a_2/a_1)}{2\pi}$$

Signed and Sealed this

Fifth Day of October, 1993

Bruce Lehman

*Attest:*

BRUCE LEHMAN

*Attesting Officer*

*Commissioner of Patents and Trademarks*